US006332934B2

(12) United States Patent
Tanida et al.

(10) Patent No.: US 6,332,934 B2
(45) Date of Patent: Dec. 25, 2001

(54) MARTENSITIC STAINLESS STEEL FOR SEAMLESS STEEL PIPE

(75) Inventors: Mutsumi Tanida; Tetsuya Nakanishi, both of Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/758,322

(22) Filed: Jan. 12, 2001

Related U.S. Application Data

(63) Continuation of application No. PCT/JP00/03151, filed on May 17, 2000.

(30) Foreign Application Priority Data

May 18, 1999 (JP) ..... 11-137782

(51) Int. Cl.[7] ..... C22C 38/18; C22C 38/60; C22C 38/32

(52) U.S. Cl. ..... 148/325; 420/41; 420/64; 420/34

(58) Field of Search ..... 148/325; 420/34, 420/41, 64

(56) References Cited

U.S. PATENT DOCUMENTS 5,314,549 * 5/1994 Misao et al. ..... 148/325
5,427,635 * 6/1995 Bletton et al. ..... 148/325
6,146,475 * 11/2000 Kosa ..... 148/325

FOREIGN PATENT DOCUMENTS 57-19329 2/1982 (JP) .
5-43988 2/1993 (JP) .
06-306546 11/1994 (JP) .
09-143629 6/1997 (JP) .
52-127423 10/1997 (JP) .

* cited by examiner

*Primary Examiner*—Roy King
*Assistant Examiner*—Harry D. Wilkins, III
(74) *Attorney, Agent, or Firm*—Burns, Doane, Swecker & Mathis, LLP

(57) ABSTRACT

A martensitic stainless steel for seamless steel pipes, excellent in descaling property and machinability, having the following chemical composition, by weight %; 0.025 to 0.22% of C, 10.5 to 14% of Cr, 0.16 to 1.0% of Si, 0.05 to 1.0% of Mn, 0.05% or less of Al, 0.100% or less of N, 0.25% or less of V, 0.020% or less of P, 0.004 to 0.015% of S, and the balance Fe and impurities, This steel may include 0.0002 to 0.0050% of B, and/or 0.0005 to 0.005% of Ca. In this case, the upper limit of S may be extended up to 0.018%. Preferably, Al is limited to less than 0.01%.

20 Claims, No Drawings

MARTENSITIC STAINLESS STEEL FOR SEAMLESS STEEL PIPE

This application is a continuation of International Application No. PCT/JP00/03151 filed on May 17, 2000, which designates the United States. The International Application was published on Nov. 23, 2000, but not in English.

TECHNICAL FIELD

The present invention relates to a steel used for making a material of seamless steel pipes, such as oil well pipes or line pipes, and particularly to a martensitic stainless steel characterized by having excellent descaling property and machinability.

BACKGROUND ART

Martensitic stainless steels defined as SUS 410, SUS420 and others in JIS (Japanese Industrial Standards) have high strength and excellent corrosion resistance even in a corrosive environment containing $CO_2$, and thereby have been used as materials for seamless steel pipes, such as oil well pipes, line pipes, geothermal well pipes and others.

The seamless steel pipe is generally produced by means of an inclined rolling method, such as Mannesmann plug mill process and Mannesmann mandrel mill process, a hot extrusion method such as Ugine-Sejournet process, or a hot press method such as Erhart pushbench process. It has been known that reducing S (sulfur) in addition to keeping down Cr equivalent [Cr+4Si−(22C+0.5Mn+1.5Ni+30N)] of a steel was desirable to prevent surface defects, such as cracks and scabs (or laps), which are likely to result from these hot workings.

In oil well pipes and the like, it is often the case that each of the pipes is provided with connecting screws at both ends. The martensitic stainless steel originally has a large cutting resistance, and the steel, having the reduced S content as described above, is likely to experience a seizure between a cutting tool and a cutting work in the same manner as austenitic stainless steels. This results in a shortened life of the cutting tool and greatly reduces the efficiency of production.

Publication of the unexamined patent application Sho-52-127423 discloses a martensitic stainless steel excellent in machinability, including 0.003 to 0.40% of rare earth element. However, according to test result of the present inventors, the rare earth element has no effect to improve machinability and besides that it increases inclusions in the steel, particularly deteriorating the quality of threaded portion. In this steel, S (sulfur) is limited to 0.03% or less on the grounds that it impairs corrosion resistance and hot-workability. In addition, the hot-workability is merely evaluated based entirely on the condition of scabs created during rolling the steel into a plate, and it is not clear whether the hot-workability for forming a seamless steel pipe is sufficient or not.

Publication of the unexamined patent application Hei-5-43988 discloses a martensitic stainless steel including 13.0 to 17.0% of Cr, and optionally less than about 0.5% of S (preferably 0.1 to 0.5 to improve machinability). However, this steel includes about 1.5 to 4.0% of Cu. Since Cu is a component, which significantly deteriorates the hot-workability of steel, such a steel, including a large quantity of Cu, is not a suitable material for producing the seamless steel pipe by the inclined rolling method or the like.

Publication of the unexamined patent application Hei-9-143629 discloses an invention of a material pipe for steel pipe joint couplings, in which 0.005 to 0.050% of S is included as well as 5.0 to 20.0% of Cr so as to arrange "Mn/S" in 35 to 110. In this invention, the hot forging process is applied to produce the above material pipe for couplings, on the basis of the recognition that a Cr steel seamless pipe of high S content cannot be produced by the inclined rolling method such as the Mannesmann processes, due to its inferior hot-workability, That is, the material pipe disclosed in the publication is a short size pipe, which is produced by a hot forging process. In addition, while Al content is defined to 0.010 to 0.035% in the claim of the publication, actual Al content is unclear because there is no description of the Al content of the steel as examples. Since Al creates oxide compounds including $Al_2O_3$, which is hard and has a high melting point, it accelerates wear on cutting tools, it is generally required to limit the Al content or to control the oxide composition by other components, such as Ca. However, these are not considered in the invention of this publication.

With respect to oil well pipes of 13Cr stainless steel (martensitic stainless steel), the API (American Petroleum Institute) Standards require "no scale on an inner surface of the pipe". In the 13Cr stainless steel, it is difficult to remove scale uniformly. Particularly a low sulfur martensitic stainless steel has a significantly low descaling property due to the high adhesion between the scale and the surface of the steel, and the scale is thereby apt to remain on the surface.

DISCLOSURE OF INVENTION

The present invention has been addressed for the purpose of the improving machinability and descaling property of martensitic stainless steel while keeping up its inherent mechanical property and corrosion resistance.

The present inventors have significantly improved the machinability and the descaling property while maintaining its fundamental characteristics by most suitably selecting alloying elements and content thereof composing the martensitic stainless steel.

As described above, heretofore, in the martensitic stainless steel, the S content has been limited as low as possible in order to improve its hot-workability. However, according to the result of inventors' detailed studies, an optimal content of S can yield not only enhanced machinability but also improved the descaling property of the steel. On the other hand, the deterioration of hot-workability and associated difficulty in the production of seamless steel pipes (problem of cracks and scabs occurring during piercing) can be settled by improving pipe-producing techniques. For example, piecing with low reduction in roll gorge, or piecing by cone-type rolls piercing mill, which was developed by the present applicant, makes it possible to produce, by the inclined rolling method, a high quality seamless steel pipe equal to the conventional seamless steel pipes of low S steel. Further, improvement of material quality, i.e., improvement of hot-workability, can also be achieved by adding B (boron).

Suppressing Al content or adding a suitable amount of Ca can further enhance the effect of improving the machinability by adding a suitable amount of S.

A subject matter of the present invention, based on the above knowledge, is defined as the following martensitic stainless steel. Hereinafter, % in each component's content stands for weight %.

(1) A martensitic stainless steel for seamless steel pipes, excellent in descaling property and machinability, the martensitic stainless steel consisting of 0.025 to 0.22% of C, 10.5 to 14% of Cr, 0.16 to 1.0% of Si, 0.05 to 1.0% of Mn, 0.05% or less of Al, 0.100% or less of N, 0.25% or less of V, 0.020% or less of P, and 0.004 to 0.015% of S, and the balance being Fe and impurities.

(2) A martensitic stainless steel for seamless steel pipes, excellent in descaling property and machinability, the martensitic stainless steel consisting of 0.025 to 0.22% of C, 10.5 to 14% of Cr, 0.16 to 1.0% of Si, 0.05 to 1.0% of Mn, 0.0002 to 0.0050% of B, 0.05% or less of Al, 0.100% or less of N, 0.25% or less of V, 0.020% or less of P, and 0.004 to 0.018% of S, and the balance being Fe and impurities.

(3) A martensitic stainless steel for seamless steel pipes, excellent in descaling property and machinability, in which 0.0005 to 0.0050% of Ca is further included in the above steel (1) or (2)

When Ca is included, the S content of the above steel (1) can also be 0.004 to 0.018%.

As described above, since Al creates $Al_2O_3$ and thereby deteriorates machinability, the Al content in the steels (1) to (3) is preferably 0.01% or less, and more preferably 0.005% or less. In the steels (1) to (3), up to 0.6% of Ni may also be included as an impurity. However, as described later, since Ni adversely affects sulfide cracking resistance of the steel and deteriorates descaling property, the Ni content should be preferably 0.2% or less and more preferably 0.1% or less.

"Martensitic stainless steel", herein, means a steel the major structure of which is martensite, and small amounts (up to about 5% by area) of other structure, such as ferrite, bainite, pearlite, may be mixed therein.

BEST MODE FOR CARRYING OUT THE INVENTION

The martensitic stainless steel of the present invention has overall excellent characteristics as seamless steel pipes by the synergism of the respective components described above. Each effect of the components is as follows.

C (Carbon) may enhance strength of steel. In order to obtain such an effect, the C content is required to be 0.025% or more. On the other hand, more than 0.22% of C deteriorates corrosion resistance of steel and allows cracks to occur during quenching.

Cr (Chromium) is a primary component of steel for enhancing corrosion resistance. Particularly Cr of 10.5% or more improves resistance to pitting corrosion and crevice corrosion, and it further significantly enhances corrosion resistance under an environment containing $CO_2$. On the other hand, more than 14% of the content allows δ-ferrite to be created during workings under high temperature because chromium is an element to form ferrite, resulting in deteriorated hot-workability. In addition, an excessive amount of chromium causes an increased ferrite in the steel, and thereby deteriorates the strength of the steel after the heat treatment (tempering treatment described hereinafter) which assures stress-corrosion cracking resistance. Based on these reasons, the chromium content was defined in the range of 10.5 to 14%.

Si (Silicon) is an element required as a deoxidizer in order to remove oxygen which deteriorates the hot-workability. If the content is less than 0.16%, the deoxidizing effect is insufficient, and no improvement in hot-workability is obtained. On the other hand, excessive amount of Si causes a deteriorated toughness of the steel. Thus, the upper limit of Si content is defined in 1.0%.

Mn (Manganese) is also an element required as a deoxidizer in steel making and contributes to enhance the strength of the steel. Mn also stabilizes sulfur in the steel as MnS and improves the hot-workability. In less than 0.05% of the manganese contents, the deoxidizing effect is insufficient, resulting in a poor effect of improvement in the hot-workability. However, since excessive manganese content causes a deteriorated toughness of the steel, the upper limit should be defined in 1.0%. Regarding the importance of toughness, the Mn content is preferably selected as low as possible, for example 0.30% or less in the range of 0.05% or more.

Al (aluminum) is effective as a deoxidizer of steel. Thus, in case of necessity, Al is added to the steel of the present invention. However, since aluminum creates oxide compounds mostly comprised of hard and high melting point $Al_2O_3$, which accelerate wear on cutting tools, as described above, its content is preferably as little as possible. In addition, an excessive amount of aluminum deteriorates cleanliness of steel and a choking of an immersed nozzle during continuous casting.

For the above reasons, when aluminum is added, its content must be limited to 0.05% or less. It is recommendable that aluminum is not positively added and its content is in the range of less than 0.01% or, more preferably, not more than 0.005%. In case of a steel containing Calcium, the aluminum content may be selected in a relative high range of 0.05% or less because calcium oxide forms low melting point oxide compounds in cooperation with the oxides of aluminum, silicon, manganese, and others, and thereby offsets the adverse effect of aluminum.

N (nitrogen) may be included up to 0.100% because it reduces the chromium equivalent and thereby improves hot-workability. However, more than 0.100% of N deteriorates the toughness of steel. Although N may not be positively added, its content is preferably selected in the range of 0.020 to 0.100% when its effect of strengthening and improving the hot-workability of the steel is expected.

Generally, in martensitic stainless steels, S (sulfur) has heretofore been considered as an impurity, which deteriorates hot-workability and should be limited as low as possible. In contrast, this sulfur is positively utilized in the present invention. However, when the after-mentioned B and/or Ca are not added, more than 0.015% of the sulfur causes a significant deterioration in hot-workability. Therefore, it will be difficult to prevent the occurrence of scabs during piercing by an inclined rolling mill in the producing process of seamless pipes, even if the producing conditions are improved.

Sulfur concentrates in the boundary surface between the scale and the substrate after the steel is processed into a pipe so that the removing property of the scale on the outer and the inner surfaces (descaling property) is significantly improved. Thus, the S content is defined in the range of 0.004 to 0.015%. When one or both of B and Ca are added, the upper limit of S is extended up to 0.018%.

P (phosphorus) is an impurity of steel, and its high content deteriorates the toughness of steel pipe products. The allowable upper limit is 0.020% to secure toughness and it is preferable to be as little as possible, in the range of not more than 0.020%, and specifically not more than 0.018%.

B (boron) is effective for preventing hot-workability from being deteriorating due to the grain boundary segregation of sulfur in steel. It also has effects for making crystal gains fine to enhance toughness and lowering the melting point of oxide compounds. Thus, boron may be added if necessary. When B is added, its content is preferably selected in the range of 0.0002% or more to assure the above effects.

However, more than 0.0050% of boron causes precipitation of carbide on grain boundaries and likely deteriorates corrosion resistance of the steel. Thus, the upper limit is defined in 0.0050%.

Calcium combines with sulfur and O (oxygen) to create sulfide (CaS) and oxide (CaO), and then these transform the hard and high melting point oxide compounds ($Al_2O_3$—MnO—$SiO_2$ oxide) into a low melting point and soft oxide compounds which improves the machinability of steel. These effects are exhibited when the calcium content is in the range of 0.0005% or more, however, excessive calcium content reduces the sulfur, which concentrates in the boundary surface between the scale and the substrate, resulting in a deteriorated scale removing property (descaling property). The excessive calcium also causes inclusions on steel product after hot working. Summing up these effects of calcium, when calcium is added, its content should be defined in the range of 0.0005 to 0.005%. Calcium addition is not always necessary as the same as the aforementioned boron.

V (vanadium) contributes to enhance the strength of steel through its precipitation hardening effect. It also serves for improving machinability by lowering the melting point of the oxide compounds. Thus, vanadium may be added at needed. However, when V is added, the vanadium content should be limited up to 0.25% because excessive vanadium deteriorates the toughness of the steel. The vanadium content should preferably be selected in the range of 0.12 to 0.18% when a product having high strength is required.

Ni (nickel) is an element being mixed in steel to a certain extent from scraps and others during steel making. In the present invention, Ni may also be included as an inevitable impurity in the range of 0.6% or less as defined in JIS. However, nickel increases adhesion of scale, and deteriorates descaling property. This adverse effect becomes significant when the nickel content is more than 0.2%, thus, the nickel content is preferably suppressed to 0.2% or less. Further, the nickel content is more preferably suppressed to 0.10% or less because a sulfide stress-corrosion cracking is likely to occur in the steel containing nickel, when it is used in an environment containing sulfide.

O (oxygen) is included in steel as an inevitable impurity. Oxygen is combined with chromium, aluminum, silicon, manganese, sulfur, and others to form oxides. While these oxides affect machinability and mechanical property, the steel of the present invention does not have that problem, even if the oxygen content is in the range (about 10 to 200 ppm) as much as that normally achieved by the conventional refining process for stainless steel.

As described above, when one or more of B and Ca are added, the upper limit of S can be extended up to 0.018%. That is, increased sulfur further improves machinability and descaling property of the steel while keeping up sufficient hot-workability.

While the stainless steel of the present invention may mix some other structure as described above, this stainless steel is substantially composed of martensite structure. This structure and a predetermined mechanical property can be achieved by subjecting, for example, to the following heat treatment after the steel has been processed to a product (seamless steel pipe).

Quenching: heating at 920 to 1050° C. for about 20 minutes, and then air-quenching (air-cooling or forced air-cooling), Tempering: heating at 625 to 750° C. for about 30 minutes, and then air-cooling.

EXAMPLE

Three billets (outer diameter: 191 mm) of each steel, having the chemical composition shown in Table 1 and Table 2, were prepared. These billets were heated at 1230° C. and then piercing-rolled with 6.5% of the relative reduction in front of the plug nose by an inclined roll piercer having a 10° cross angle. Each obtained hollow shell was extracting-rolled by a mandrel mill, heated again, and fixed-size-rolled by a stretch reducer, to produce seamless steel pipes, having 73.0 mm of outer diameter, 5.51 mm of wall thickness, and 9700 mm of length. Five steel pipes were produced from each billet. Thus, fifteen sample steel pipes were obtained from each steel having respective ones of compositions shown in Tables 1 and 2.

The above pipes were subjected to quenching at "980° C.×20 minutes—air-cooling", and to tempering under the following condition.

80 ksi grade pipes (YS: 600 to 620 MPa, TS: 745 to 780 MPa)
720° C.×30 minutes—air-cooling 95 ksi grade pipes (YS: 680 to 700 MPa, TS: 830 to 850 MPa)
700° C.×30 minutes—air-cooling The structure, after the heat treatment of all sample steel pipes, was substantially tempered martensite. The following tests (or inspections) were performed on each obtained pipe. The test results are shown Table 3 and Table 4.

(1) Inspection of the status of defect (scabs) on inner and outer surfaces.

The defects were visually checked. The cases in which pipes necessary for some repairs in order to remove scabs were 8 or more (among the fifteen pipes), or pipes that can not be used as commercial products, after the repairs, were 2 or more, are indicated by a mark X, and other cases are indicated by a mark ○.

(2) Descaling test:

The inner and the outer surface of each pipe was descaled to Sa2-½ level of the ISO standard by suction shot blasting using fused alumina particles (#16). The descaling property was evaluated based on "descaling efficiency" determined by calculating the number of pipes which could be processed per hour, in accordance with the time which passed over the above descaling operation for one pipe.

(3) Machinability test

A cutting test was performed by a process comprising providing Buttress type threads of the API standards in each end of the pipes after descaling, cutting off the threaded portion for each threading, and repeatedly providing threads in each end of the pipes. A chaser coated by CVD method was used as the cutting tool. "Cutting efficiency" was determined by calculating the number of pipes, which could be cut per hour, in accordance with the time needed for the above one threading operation. The number of threading, which was performed by one tool, was determined "Tool life".

(4) Charpy impact test

A test piece of 10mm×3.3 mm×55 mm which had 2 mm V notch was used. The test piece was cut out in the longitudinal direction of a pipe, which was selected from each set of pipes of the same chemical composition. The impact test was performed at 0° C. of test temperature, and "absorbed energy" and "ductile—brittle transition temperature (vTrs)" was determined.

The steel A shown Table 1 is a conventional martensitic stainless steel corresponding to SUS 420J2. The steels A1 to A3 are steels made for comparison, all of which include S exceeding the range of the present invention.

Referred to the test result in Table 3, the conventional steel A had no flaw because it had low S content of 0.001%. However, it had a significantly inferior machinability and low descaling property.

On the other hand, while the comparative materials A1 to A3 were improved in machinability and descaling property, all of the pipes included surface defects, which occurred during the pipe production process, and thereby needed repairs. This was due to the occurrence of scabs, which was due to their excessive content of S, and could not be avoided despite applying the piecing conditions as described above.

In the steels belonging to B group to F group, all of steels corresponding to the present invention have the machinability and descaling property superior to the comparative steels in each group, and had no defects during the pipe production process. This means that the steels of this invention also have excellent hot-workability. Particularly, the steels including boron have no surface defects, even if they have relatively high sulfur content, and exhibit excellent machinability. In the steels in which the nickel content was suppressed to 0.2% or less, descaling property is further improved as compared to the steels including relatively high nickel content.

As is apparent from Table 3, the steels of this invention, the sulfur contents of which were arranged in a suitable range, were on almost the same level of mechanical characteristics with the conventional steels and the comparative steels in each group.

The steels in Table 2 have relatively high aluminum content, and steels of I group, J group and K group include calcium. The test results of these sample members are shown in Table 4. It is apparent from Table 4 that the steels of the G and H groups were slightly inferior in machinability to the steels having lower aluminum content described above. However, the steels of the I to K groups including calcium had excellent machinability regardless of the high aluminum content.

The steels in the group F in Table 1 and group K in Table 2 are high strength steels (95 ksi grade) including vanadium. As shown in Table 3 and 4, they had somewhat inferior toughness, but had machinability superior to that of the steels which do not include vanadium.

INDUSTRIAL APPLICABILITY

As show in the Example, the steel of the present invention is remarkably superior to conventional martensitic stainless steel in machinability and descaling property. In addition, it has substantially the same hot-workability as that of the steel having the low S content, and has no occurrence of surface defects during the pipe production process. This steel is significantly useful for materials of seamless steel pipes because of its mechanical characteristics and corrosion resistance which are equivalent to those of conventional martensitic stainless steels.

TABLE 1

| Steel | Chemical Composition of Test Piece (weight: %, bal.: Fe) | | | | | | | | | | | Remarks | |
|---|---|---|---|---|---|---|---|---|---|---|---|---|---|
| No. | C | Si | Mn | P | S | Cr | Ni | Al | N | B | V | Classification (*) | Main Feature |
| A | 0.20 | 0.22 | 0.82 | 0.013 | 0.001 | 12.82 | 0.28 | 0.0010 | 0.031 | | | Conventional Steel | Steel Equivalent to SUS 420 |
| A1 | 0.19 | 0.18 | 0.84 | 0.015 | 0.017 | 12.75 | 0.12 | 0.0010 | 0.029 | | | Comparative Steel | high S - no B |
| A2 | 0.20 | 0.18 | 0.84 | 0.015 | 0.020 | 12.84 | 0.12 | 0.0008 | 0.030 | 0.0003 | | Comparative Steel | high S - low B |
| A3 | 0.18 | 0.19 | 0.84 | 0.014 | 0.020 | 12.62 | 0.10 | 0.0011 | 0.032 | 0.0047 | | Comparative Steel | high S - high B |
| B | 0.20 | 0.21 | 0.80 | 0.015 | 0.005 | 12.82 | 0.42 | 0.0008 | 0.028 | | | Example Steel | low Al - low S |
| B1 | 0.20 | 0.20 | 0.80 | 0.013 | 0.009 | 12.99 | 0.51 | 0.0009 | 0.028 | | | Example Steel | low Al - midium S |
| B2 | 0.19 | 0.19 | 0.80 | 0.013 | 0.014 | 12.85 | 0.38 | 0.0008 | 0.027 | | | Example Steel | low Al - high S |
| B3 | 0.20 | 0.21 | 0.10 | 0.014 | 0.014 | 12.64 | 0.39 | 0.0009 | 0.029 | | | Example Steel | low Al - high S, low Mn |
| B4 | 0.19 | 0.20 | 0.79 | 0.012 | 0.002 | 12.72 | 0.52 | 0.0011 | 0.031 | | | Comparative Steel | low Al - very low S |
| C | 0.20 | 0.22 | 0.79 | 0.015 | 0.006 | 12.76 | 0.39 | 0.0008 | 0.029 | 0.0009 | | Example Steel | low Al - B - low S |
| C1 | 0.18 | 0.21 | 0.79 | 0.013 | 0.010 | 12.92 | 0.42 | 0.0008 | 0.031 | 0.0007 | | Example Steel | low Al - B - midium S |
| C2 | 0.20 | 0.18 | 0.80 | 0.014 | 0.017 | 12.83 | 0.51 | 0.0009 | 0.028 | 0.0009 | | Example Steel | low Al - B - high S |
| C3 | 0.19 | 0.22 | 0.12 | 0.013 | 0.018 | 12.89 | 0.46 | 0.0007 | 0.028 | 0.0008 | | Example Steel | low Al - B - high S, low Mn |
| C4 | 0.19 | 0.21 | 0.78 | 0.013 | 0.001 | 12.72 | 0.48 | 0.0008 | 0.027 | 0.0009 | | Comparative Steel | low Al - B - very low S |
| D | 0.20 | 0.20 | 0.81 | 0.014 | 0.005 | 12.61 | 0.12 | 0.0008 | 0.030 | | | Example Steel | low Al - low Ni - low S |
| D1 | 0.19 | 0.18 | 0.80 | 0.015 | 0.009 | 12.75 | 0.12 | 0.0008 | 0.029 | | | Example Steel | low Al - low Ni - midium S |
| D2 | 0.19 | 0.21 | 0.79 | 0.014 | 0.015 | 12.83 | 0.11 | 0.0009 | 0.030 | | | Example Steel | low Al - low Ni - high S |
| D3 | 0.18 | 0.19 | 0.15 | 0.013 | 0.014 | 12.78 | 0.12 | 0.0008 | 0.031 | | | Example Steel | low Al - low Ni - high S, low Mn |
| D4 | 0.19 | 0.22 | 0.78 | 0.014 | 0.001 | 12.78 | 0.11 | 0.0009 | 0.032 | | | Comparative Steel | low Al - low Ni - very low S |
| E | 0.20 | 0.18 | 0.80 | 0.014 | 0.004 | 12.62 | 0.12 | 0.0007 | 0.030 | 0.0009 | | Example Steel | low Al - low Ni - B - low S |
| E1 | 0.19 | 0.21 | 0.79 | 0.015 | 0.008 | 12.81 | 0.12 | 0.0007 | 0.031 | 0.0008 | | Example Steel | low Al - low Ni - B - midium S |
| E2 | 0.19 | 0.18 | 0.82 | 0.013 | 0.017 | 12.85 | 0.11 | 0.0009 | 0.030 | 0.0009 | | Example Steel | low Al - low Ni - B - high S |
| E3 | 0.19 | 0.22 | 0.11 | 0.015 | 0.018 | 12.94 | 0.13 | 0.0008 | 0.028 | 0.0008 | | Example Steel | low Al - low Ni - B - high S, low Mn |
| E4 | 0.19 | 0.20 | 0.81 | 0.014 | 0.002 | 12.86 | 0.12 | 0.0007 | 0.029 | 0.0009 | | Comparative Steel | low Al - low Ni - B - verv low S |
| F | 0.18 | 0.21 | 0.78 | 0.014 | 0.006 | 12.75 | 0.07 | 0.0010 | 0.025 | | 0.15 | Example Steel | low Al - low Ni - V - low S |
| F1 | 0.19 | 0.22 | 0.77 | 0.013 | 0.011 | 12.81 | 0.10 | 0.0009 | 0.024 | 0.0007 | 0.14 | Example Steel | low Al - low Ni - V - B, medium S |
| F2 | 0.19 | 0.20 | 0.79 | 0.015 | 0.016 | 12.85 | 0.08 | 0.0009 | 0.020 | 0.0009 | 0.13 | Example Steel | low Al - low Ni - V - B, high S |
| F3 | 0.19 | 0.21 | 0.82 | 0.012 | 0.017 | 12.78 | 0.07 | 0.0010 | 0.027 | 0.0008 | 0.14 | Example Steel | low Al - low Ni - V - B, high S, low Mn |
| F4 | 0.20 | 0.20 | 0.81 | 0.015 | 0.001 | 12.79 | 0.09 | 0.0009 | 0.026 | 0.0007 | 0.14 | Comparative Steel | low Al - low Ni - V - B, very low S |

(*) "Examples Steel" is the steel of the present invention.

TABLE 2

| Steel | Chemical Composition of Test Piece (weight: %, bal.: Fe) | | | | | | | | | | | | Remarks | |
|---|---|---|---|---|---|---|---|---|---|---|---|---|---|---|
| No. | C | Si | Mn | P | S | Cr | Ni | Al | N | B | V | Ca | Classification (*) | Main Feature |
| G | 0.19 | 0.22 | 0.78 | 0.016 | 0.005 | 12.81 | 0.12 | 0.0030 | 0.035 | | | | Examples Steel | high Al - low S |
| G1 | 0.18 | 0.19 | 0.77 | 0.014 | 0.010 | 12.88 | 0.15 | 0.0052 | 0.038 | | | | Examples Steel | high Al - medium S |
| G2 | 0.19 | 0.19 | 0.81 | 0.012 | 0.011 | 12.83 | 0.21 | 0.0083 | 0.041 | | | | Examples Steel | high Al - high S |
| G3 | 0.19 | 0.22 | 0.20 | 0.015 | 0.012 | 12.49 | 0.18 | 0.0131 | 0.041 | | | | Examples Steel | high Al - high S, low Mn |
| G4 | 0.20 | 0.18 | 0.78 | 0.013 | 0.003 | 12.68 | 0.11 | 0.0025 | 0.039 | | | | Comparative Steel | high Al - very low S |
| H | 0.21 | 0.19 | 0.77 | 0.017 | 0.004 | 12.52 | 0.05 | 0.0010 | 0.035 | 0.0008 | | | Examples Steel | high Al - low Ni - B - low S |
| H1 | 0.18 | 0.19 | 0.72 | 0.016 | 0.009 | 12.68 | 0.08 | 0.0028 | 0.037 | 0.0007 | | | Examples Steel | high Al - low Ni - B - medium S |
| H2 | 0.19 | 0.20 | 0.73 | 0.012 | 0.015 | 12.70 | 0.06 | 0.0080 | 0.038 | 0.0008 | | | Examples Steel | high Al - low Ni - B - high S |
| H3 | 0.19 | 0.18 | 0.20 | 0.011 | 0.018 | 12.81 | 0.07 | 0.0052 | 0.041 | 0.0007 | | | Examples Steel | high Al - low Ni - B - high S, low Mn |
| H4 | 0.20 | 0.22 | 0.78 | 0.017 | 0.002 | 12.78 | 0.08 | 0.0038 | 0.040 | 0.0010 | | | Comparative Steel | high Al - low Ni - B - very low S |
| I | 0.19 | 0.18 | 0.82 | 0.013 | 0.006 | 12.81 | 0.41 | 0.0009 | 0.042 | | | 0.0006 | Examples Steel | high Al - Ca - low S |
| I1 | 0.19 | 0.16 | 0.80 | 0.015 | 0.009 | 12.65 | 0.50 | 0.0013 | 0.035 | | | 0.0005 | Examples Steel | high Al - Ca - medium S |
| I2 | 0.20 | 0.19 | 0.81 | 0.014 | 0.014 | 12.72 | 0.39 | 0.0025 | 0.038 | | | 0.0007 | Examples Steel | high Al - Ca - high S |
| I3 | 0.19 | 0.21 | 0.11 | 0.012 | 0.015 | 12.90 | 0.38 | 0.0032 | 0.041 | | | 0.0008 | Examples Steel | high Al - Ca - high S, low Mn |
| I4 | 0.20 | 0.20 | 0.78 | 0.013 | 0.002 | 12.79 | 0.52 | 0.0040 | 0.040 | | | 0.0006 | Comparative Steel | high Al - Ca - very low S |
| J | 0.20 | 0.21 | 0.78 | 0.014 | 0.004 | 12.92 | 0.11 | 0.0052 | 0.035 | 0.0009 | | 0.0005 | Examples Steel | high Al - Ca - low Ni, B - low S |
| J1 | 0.19 | 0.19 | 0.79 | 0.013 | 0.009 | 12.61 | 0.13 | 0.0132 | 0.036 | 0.0008 | | 0.0006 | Examples Steel | high Al - Ca - low Ni, B - medium S |
| J2 | 0.19 | 0.18 | 0.81 | 0.015 | 0.017 | 12.78 | 0.10 | 0.0088 | 0.035 | 0.0008 | | 0.0007 | Examples Steel | high Al - Ca - low Ni, B - high S |
| J3 | 0.19 | 0.18 | 0.13 | 0.014 | 0.017 | 12.76 | 0.12 | 0.0072 | 0.038 | 0.0009 | | 0.0006 | Examples Steel | high Al - Ca - low Ni, B - high S, low Mn |
| J4 | 0.20 | 0.19 | 0.80 | 0.015 | 0.001 | 12.92 | 0.13 | 0.0020 | 0.037 | 0.0009 | | 0.0005 | Comparative Steel | high Al - Ca -low Ni, B - very low S |
| K | 0.18 | 0.18 | 0.81 | 0.014 | 0.005 | 12.85 | 0.07 | 0.0090 | 0.021 | | 0.14 | 0.0007 | Examples Steel | high Al - V - Ca - low Ni - low S |
| K1 | 0.19 | 0.19 | 0.80 | 0.013 | 0.009 | 12.83 | 0.07 | 0.0013 | 0.022 | 0.0007 | 0.15 | 0.0008 | Examples Steel | high Al - V - Ca - low Ni - B, medium S |
| K2 | 0.20 | 0.20 | 0.78 | 0.014 | 0.016 | 12.71 | 0.08 | 0.0022 | 0.023 | 0.0008 | 0.14 | 0.0011 | Examples Steel | high Al - V - Ca - low Ni - B, high S |
| K3 | 0.19 | 0.21 | 0.81 | 0.013 | 0.018 | 12.78 | 0.11 | 0.0019 | 0.028 | 0.0009 | 0.15 | 0.0009 | Examples Steel | high Al - V - Ca - low Ni - B, high S, low Mr |
| K4 | 0.20 | 0.19 | 0.80 | 0.012 | 0.001 | 12.80 | 0.09 | 0.0018 | 0.025 | 0.0008 | 0.14 | 0.0012 | Comparative Steel | high Al - V - Ca - low Ni - very low S |

(*) "Example Steel" is the steel of the present invention.

TABLE 3

| Steel No. | State of defects | Machinability | | | ° C. Charpy Absorbed Energy (J) | vTrs (° C.) |
|---|---|---|---|---|---|---|
| | | Cutting Efficiency (number/hr) | Tool Life (*) | Descaling Property (number/hr) | | |
| A | ○ | 44 | 72 | 12 | 45 | −20 |
| A1 | x | 67 | 128 | 25 | 38 | −15 |
| A2 | x | 64 | 125 | 26 | 41 | −15 |
| A3 | x | 65 | 124 | 24 | 39 | −15 |
| B | ○ | 56 | 94 | 24 | 47 | −20 |
| B1 | ○ | 61 | 118 | 28 | 49 | −15 |
| B2 | ○ | 60 | 123 | 30 | 51 | −15 |
| B3 | ○ | 62 | 122 | 31 | 69 | −30 |
| B4 | ○ | 46 | 79 | 15 | 51 | −20 |
| C | ○ | 54 | 98 | 23 | 52 | −20 |
| C1 | ○ | 62 | 117 | 27 | 49 | −15 |
| C2 | ○ | 66 | 129 | 29 | 53 | −15 |
| C3 | ○ | 65 | 126 | 31 | 71 | −30 |
| C4 | ○ | 47 | 81 | 16 | 53 | −20 |
| D | ○ | 55 | 91 | 20 | 45 | −20 |
| D1 | ○ | 60 | 119 | 23 | 42 | −20 |
| D2 | ○ | 62 | 128 | 26 | 45 | −15 |

TABLE 3-continued

| Steel No. | State of defects | Machinability: Cutting Efficiency (number/hr) | Machinability: Tool Life (*) | Descaling Property (number/hr) | ° C. Charpy Absorbed Energy (J) | vTrs (° C.) |
|---|---|---|---|---|---|---|
| D3 | ○ | 63 | 126 | 25 | 68 | −30 |
| D4 | ○ | 43 | 73 | 12 | 46 | −20 |
| E | ○ | 53 | 96 | 20 | 45 | −20 |
| E1 | ○ | 63 | 115 | 23 | 40 | −20 |
| E2 | ○ | 67 | 126 | 26 | 39 | −15 |
| E3 | ○ | 66 | 123 | 25 | 67 | −30 |
| E4 | ○ | 42 | 76 | 13 | 47 | −25 |
| F | ○ | 60 | 101 | 24 | 35 | −10 |
| F1 | ○ | 65 | 120 | 23 | 28 | −5 |
| F2 | ○ | 68 | 131 | 29 | 40 | −10 |
| F3 | ○ | 71 | 130 | 32 | 50 | −5 |
| F4 | ○ | 48 | 85 | 18 | 36 | −10 |

(*) "Tool life" is the number of threading which was performed by one tool.

TABLE 4

| Steel No. | State of defects | Machinability: Cutting Efficiency (number/hr) | Machinability: Tool Life (*) | Descaling Property (number/hr) | ° C. Charpy Absorbed Energy (J) | vTrs (° C.) |
|---|---|---|---|---|---|---|
| G | ○ | 50 | 90 | 25 | 52 | −20 |
| G1 | ○ | 56 | 110 | 27 | 51 | −20 |
| G2 | ○ | 55 | 115 | 30 | 55 | −20 |
| G3 | ○ | 58 | 120 | 30 | 70 | −30 |
| G4 | ○ | 40 | 75 | 18 | 55 | −20 |
| H | ○ | 49 | 91 | 21 | 48 | −25 |
| H1 | ○ | 55 | 100 | 18 | 45 | −20 |
| H2 | ○ | 65 | 121 | 25 | 44 | −15 |
| H3 | ○ | 65 | 119 | 24 | 51 | −30 |
| H4 | ○ | 40 | 72 | 12 | 50 | −30 |
| I | ○ | 62 | 98 | 23 | 48 | −20 |
| I1 | ○ | 70 | 129 | 27 | 49 | −15 |
| I2 | ○ | 63 | 128 | 29 | 52 | −15 |
| I3 | ○ | 65 | 130 | 28 | 68 | −30 |
| I4 | ○ | 47 | 80 | 15 | 52 | −20 |
| J | ○ | 59 | 100 | 22 | 47 | −20 |
| J1 | ○ | 64 | 120 | 24 | 42 | −25 |
| J2 | ○ | 70 | 130 | 28 | 41 | −15 |
| J3 | ○ | 68 | 128 | 27 | 69 | −30 |
| J4 | ○ | 45 | 78 | 14 | 48 | −25 |
| K | ○ | 65 | 100 | 22 | 36 | −10 |
| K1 | ○ | 68 | 121 | 25 | 38 | −10 |
| K2 | ○ | 72 | 135 | 26 | 34 | −5 |
| K3 | ○ | 75 | 130 | 29 | 51 | −5 |
| K4 | ○ | 45 | 80 | 15 | 35 | −10 |

(*) "Tool life" is the number of threading which was performed by one tool.

What is claimed is:

1. A seamless steel pipe made of a martensitic stainless steel characterized by consisting of, by weight %, 0.025 to 0.22% of C, 10.5 to 14% of Cr, 0.16 to 1.0% of Si, 0.05 to 1.0% of Mn, 0.05% or less of Al, 0.0005 to 0.0011% of Ca, 0.100% or less of N, 0.25% or less of V, 0.020% or less of P, 0.004 to 0.018% of S, and the balance Fe anad impurities, and having a micro-structure of about 95% or more martensite by area.

2. A seamless steel pipe according to claim 1, wherein Al as an impurity is suppressed to less than 0.01%.

3. A seamless steel pipe according to claim 2 that is produced by inclined rolling method.

4. A seamless steel pipe according to claim 1, wherein Al as an impurity is suppressed to 0.005% or less.

5. A seamless steel pipe according to claim 4 that is produced by inclined rolling method.

6. A seamless steel pipe according to claim 1 that is produced by inclined rolling method.

7. A seamless steel pipe according to claim 1, wherein the N content is 0.020 to 0.100%.

8. A seamless steel pipe according to claim 1, wherein the V content is 0.12 to 0.18%.

9. A seamless steel pipe according to claim 1, wherein the martensite is tempered martensite.

10. A seamless steel pipe according to claim 1, wherein the stainless steel pipe includes threaded sections at opposite ends thereof.

11. A seamless steel pipe made of a martensitic stainless steel characterized by consisting of, by weight %, 0.025 to 0.22% of C, 10.5 to 14% of Cr, 0.16 to 1.0% of Si, 0.05 to 1.0% of Mn, 0.0002 to 0.0050% of B, 0.05% or less of Al, 0.0005 to 0.0011% of Ca, 0.100% or less of N, 0.25% or less of V, 0.020% or less of P, 0.004 to 0.018% of S, and the balance Fe and impurities and having a micro-structure of about 95% or more martensite by area.

12. A seamless steel pipe according to claim 11, wherein Al as an impurity is suppressed to less than 0.01%.

13. A seamless steel pipe according to claim 12 that is produced by inclined rolling method.

14. A seamless steel pipe according to claim 11, wherein Al as an impurity is suppressed to 0.005% or less.

15. A seamless steel pipe according to claim 14 that is produced by inclined rolling method.

16. A seamless steel pipe according to claim 11 that is produced by inclined rolling method.

17. A seamless steel pipe according to claim 11, wherein the N content is 0.020 to 0.100%.

18. A seamless steel pipe according to claim 11, wherein the V content is 0.12 to 0.18%.

19. A seamless steel pipe according to claim 11, wherein the martensite is tempered martensite.

20. A seamless steel pipe according to claim 11, wherein the stainless steel pipe includes threaded sections at opposite ends thereof.

* * * * *

UNITED STATES PATENT AND TRADEMARK OFFICE

CERTIFICATE OF CORRECTION

PATENT NO. : 6,332,934 B1
DATED : December 25, 2001
INVENTOR(S) : M. Tanida et al.

It is certified that error appears in the above-identified patent and that said Letters Patent is hereby corrected as shown below:

Column 11,
Line 59, "anad" is corrected to read -- and --.

Signed and Sealed this

Fourth Day of June, 2002

*Attest:*

*Attesting Officer*

JAMES E. ROGAN
*Director of the United States Patent and Trademark Office*